United States Patent [19]

Wyon et al.

[11] Patent Number: 4,946,220

[45] Date of Patent: Aug. 7, 1990

[54] VENTILATED CHAIR OR SIMILAR DEVICE

[76] Inventors: David Wyon, Lillmyravägen 47, S-804 27 Gävle, Sweden; Christer Tennstedt, Smedjegatan 14, S-802 50 Gävle, Sweden

[21] Appl. No.: 346,830

[22] PCT Filed: Aug. 9, 1988

[86] PCT No.: PCT/SE88/00401

§ 371 Date: Jun. 14, 1989

§ 102(e) Date: Jun. 14, 1989

[87] PCT Pub. No.: WO89/01306

PCT Pub. Date: Feb. 23, 1989

[30] Foreign Application Priority Data

Aug. 17, 1987 [SE] Sweden ..... 8703176

[51] Int. Cl.[5] ..... A47C 7/72

[52] U.S. Cl. ..... 297/180; 297/DIG. 3

[58] Field of Search ..... 297/180, DIG. 3; 5/128, 5/408, 421, 423, 469

[56] References Cited

U.S. PATENT DOCUMENTS

| | | | |
|---|---|---|---|
| 1,142,876 | 6/1915 | Greenwood . | |
| 2,712,656 | 5/1952 | Radzik . | |
| 3,101,488 | 8/1963 | Peebles . | |
| 3,137,523 | 6/1964 | Karner | 297/180 |
| 3,644,950 | 2/1972 | Lindsay, Jr. | 5/469 X |
| 3,653,083 | 4/1972 | Lapidus | 5/469 X |
| 3,681,797 | 8/1972 | Messner | 297/180 X |
| 3,736,022 | 5/1973 | Radke | 297/453 |
| 4,413,857 | 11/1983 | Hayashi | 297/180 |
| 4,599,755 | 7/1986 | Tominaga | 5/423 X |
| 4,712,832 | 12/1987 | Antolini et al. | 297/180 |

FOREIGN PATENT DOCUMENTS

| | | | |
|---|---|---|---|
| FR 94 417 | 4/1969 | France . | |
| 2561006 | 9/1985 | France | 297/180 |
| SE 385 266 | 6/1976 | Sweden . | |

*Primary Examiner*—Jose V. Chen

*Attorney, Agent, or Firm*—Fleit, Jacobson, Cohn, Price, Holman & Stern

[57] ABSTRACT

A body-supporting device forming the seat (1) and/or the backrest (15) of a chair and adapted to avoid sweating caused by the thermal insulation of the chair includes at least those sections (2) of the exterior surface of the device that form the support surfaces for parts of the body of a person sitting in the chair made of air-permeable material, an internal bag member (6) having air opening (11) to the exterior of the device arranged to communicate with the interior side of the air-permeable sections (2) through holes (7) and a suction device capable of producing a negative air pressure connected to the opening. The interior of the body-supporting device is arranged so that when the suction device is running, air exterior to the support surfaces is drawn through the air-permeable sections, (2, 5), and via interior porous layer (8) and porous body (9) within the bag of the body-supporting device and out of it through the opening (11) to remove heat radiated by the body of the person, in particular from the region between contacting parts of the body and the air-permeable sections, and to cool those parts of the body by the airstreams thus created.

19 Claims, 3 Drawing Sheets

VENTILATED CHAIR OR SIMILAR DEVICE

BACKGROUND OF THE INVENTION

This invention relates to a body-supporting device forming the seat and/or back rest of a chair, its purpose being to avoid sweating caused by the thermal insulation of the chair.

The term "chair" is used to cover all types of furniture intended for sitting thereon, such as vehicle seats in all kinds of vehicles, office chairs and domestic arm chairs. This should be born in mind, as the invention is described below as it would be applied to the driver's seat of a conventional vehicle.

Every driver who has driven a car in hot weather, for example during the summer holiday period, has certainly experienced great problems with the sweating that takes place from those parts of the body that bear upon the driver's seat. This is because the chair, upon the body surfaces in contact with the chair, acts as a thermal insulator substantially obstructing and reducing the capability of the body to emit heat by radiation. The consequence is that other parts of the body must contribute more to meet the requirements of the body to be cooled by heat radiation. To achieve this it is common to open one or more windows, which results in draughts and negative consequences for health and and has a very small positive influence. However, if the temperature in the car is high enough, the body cannot loose enough heat by radiation without sweating. In this case the sweating will be particularly noticeable where the body is in contact with the chair, as an effective barrier to vapor diffusion is formed between the body and the support surfaces of the chair, making evaporation more difficult and causing these parts of the chair to become wet with sweat, which sticks to shirts, trousers and other items of clothing and causes severe discomfort. This phenomenon occurs even if the seat covers are made of material that can "breathe", avoiding non-permeable material such as leather.

In order to avoid the above disadvantages a driver's seat incorporating ducts in which cold air is circulated by a pump connected to the chair has been proposed. It is true that the circulation of the cold air inside the chair makes an increase of the heat radiation of the body from those surfaces that are in contact with the chair possible, but in practical trials with this type of chair it was found that the solution was unusable: the test drivers found after driving a vehicle with a cooled chair for some hours that their backs had become so chilled that they were unable to rise from the chair without assistance. Accordingly, the chair in question had no future.

BRIEF SUMMARY OF THE INVENTION

The object of this invention is to provide a device of the type discussed above, which would make it possible to sit comfortably in a chair without the problems mentioned above of conventional chairs, but without any negative effects upon the health of the person sitting in the chair.

A device according to the invention makes it possible to suck air through those support surfaces of the chair with which the body of a person sitting in a chair would be in contact, by which means sucked air will pass close to the contact surfaces of the seated person's body, thus cooling them in a comfortable way and keeping them dry. It has been found that in the device according to the invention the heat flow from those parts of the body forming the contact surfaces with the chair may be just as high as if the person were freely standing up, the value of the heat flow being naturally dependent on the internal construction of the device and on the suction effect utilized of the suction device in use. Furthermore, the support surfaces of the device are capable of absorbing the sweat produced, if any, and moisture that may be produced between the body and the support surfaces, thus maintaining the support surfaces dry and cool despite this due to the air stream passing.

Other advantageous features of the invention and the advantages thereof will be made apparent in the following description of a preferred embodiment of the invention, and in the dependent claims, which recite that several features have the purpose of achieving as effective and as localized a suction effect as possible, thus utilizing minimum effect in the suction device.

BRIEF DESCRIPTION OF THE DRAWINGS

A preferred embodiment of the invention, cited as an example will now be described with reference to the accompanying drawings wherein.

DETAILED DESCRIPTION OF A PREFERRED EMBODIMENT OF THE INVENTION

The following is a description of a body-supporting device which forms both seat and backrest of a chair, but it is quite possible that only the seat or only the backrest of a chair would be provided with such a device, if this were desirable. In the present case the chair is identical with the body-supporting device, and the shorter term may be used for the latter.

Figure 1:
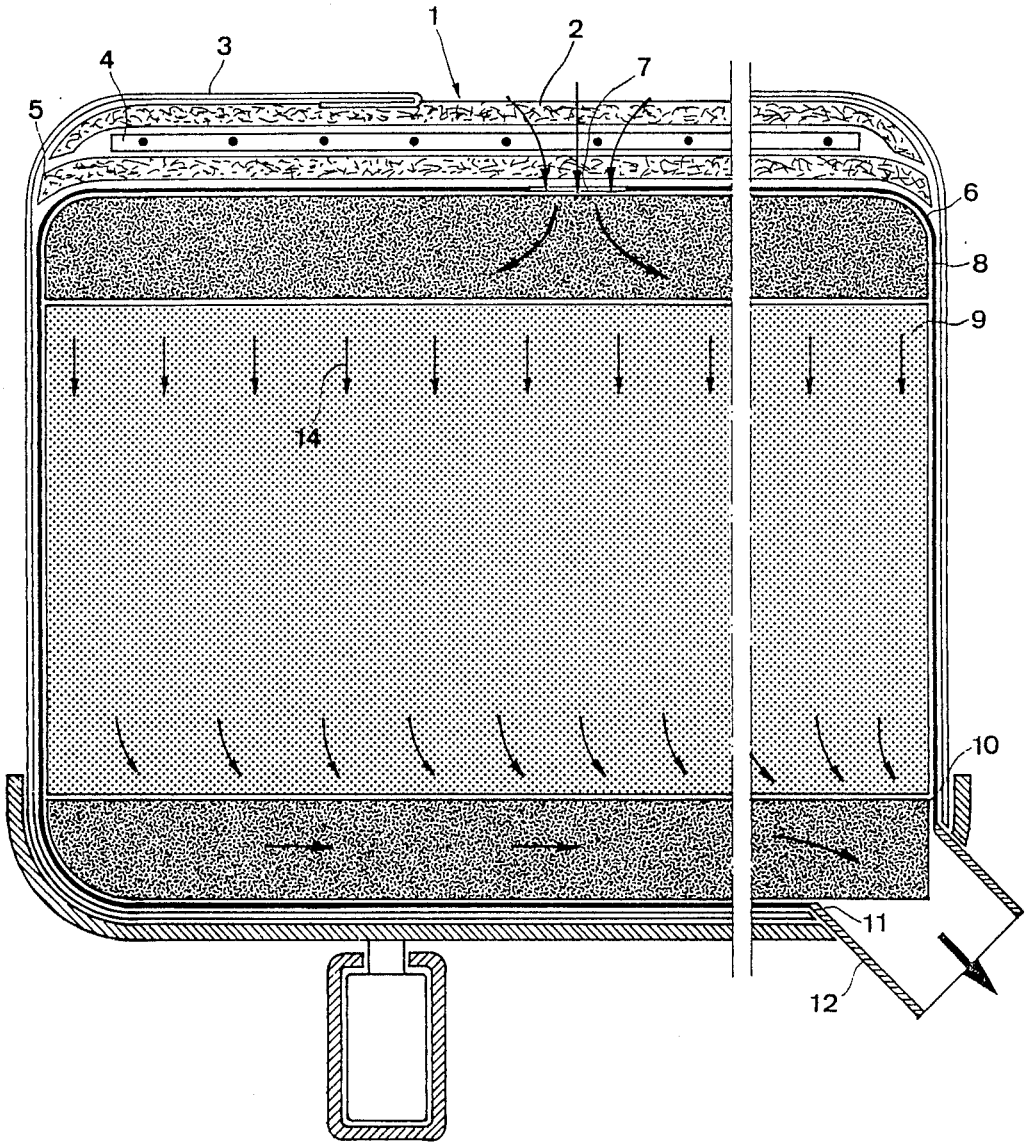
FIG. 1 is a cross-sectional view of a preferred embodiment of the invention as applied to the seat of the driver's seat of a vehicle, in which the central portion of the seat has been removed for clarity.
Figure 2:
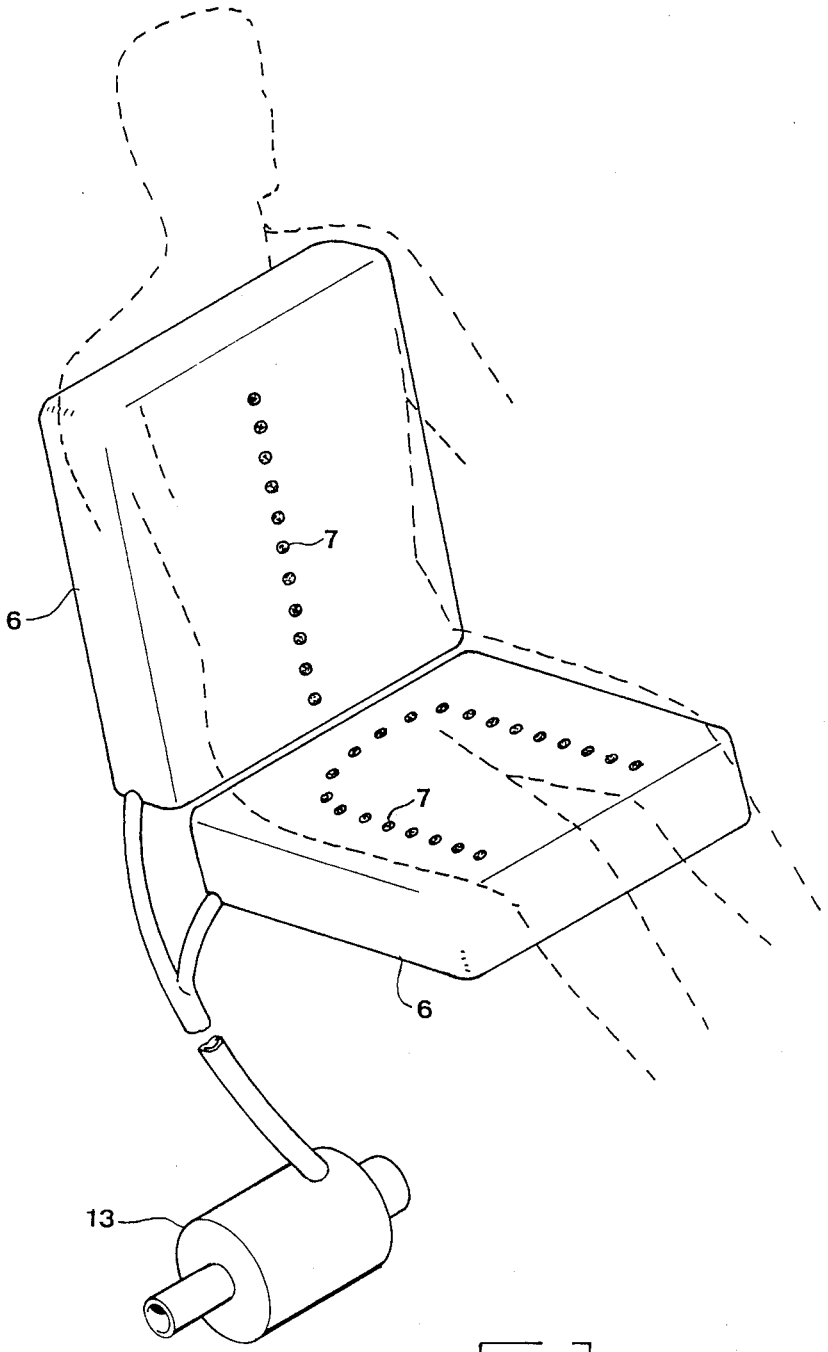
FIG. 2 is a perspective view of a seat constructed according to the invention, in which external parts have been removed to illustrate some of the details of the interior of the device important for the function of the device according to the invention.

FIG. 1 shows how the seat 1 of a chair is constructed according to the invention, the backrest being constructed in a corresponding way. The section 2 which forms supporting surfaces for parts of the body of a person sitting in the chair are made of an air-permeable material, preferably and in this example of wool. At the sides and the front of the seat, the woollen layer 2, is sewn onto an airtight layer 3, such as plastic or leather, which covers the sides and underside of the seat. The interior of the seat will now be described and to better illustrate how the seat is constructed, the component parts shown in FIG. 2 are not depicted in their correct relative scale, and for gaining further clearness layers which in reality are superposed in close contact with each other have been spaced apart. Immediately beneath the woollen layer 2 is a layer 4 with conducting circuits for electrical heating of the seat cushion. Beneath the electrical heating layer 4 is a second, woollen layer 5, similar to the first one. The woollen layers are preferably about 5 mm thick. The second woollen layer 5 is tightly connected to the airtight layer 3, so that all air penetrating through the outer, woollen layer must pass through the second woollen layer 5 in order to reach the interior of the seat.

Beneath the second woollen layer 5 is a bag 6 of virtually airtight material. The bag, in this example, is made of an elastic sheet rubber material, perforated in the direction of the second woollen layer by a number of holes 7 with a diameter of preferably about 20 mm. The elastic sheet rubber material tightly encloses and is in close contact with elements arranged in the bag. Immediately inside that side of the sheet rubber material 6 that is directed towards the support surfaces of the seat is a first layer 8 of fibrous material, here a disc of horsehair. Beneath the horsehair layer 8 is arranged a porous body 9 of foamed plastic. The thickness of the foamed plastic body is about 100 mm when not compressed. Beneath the foamed plastic body 9 is placed a second horsehair layer 10. The bag 6 has an opening 11 close to the second horsehair layer 10 and towards the side of the seat, to which is attached a preferably flexible tube 12 which protrudes from the seat and is connected to the negative pressure side of a suction turbine 13 (see FIG. 2).

The function of the device described above will now be explained. When the suction turbine 13 is powered up it creates a negative pressure at the opening 11 in the perforated sheet rubber material 6. The sheet rubber material is tightly bearing under tension against the sides of the foamed plastic body, whereby the pores close to those surfaces of the foamed plastic body are sealed, so that no air can arrive to the opening 11 without passing through the foamed plastic body 9. Both horsehair layers 8, 10 are permeable to air, as is the porous foamed plastic body 9 itself, and they have a tendency to distribute a concentrated negative air pressure uniformly over a larger area. This fact and the action of the suction turbine create a negative air pressure substantially evenly distributed over the upper side of the porous body, as indicated by the small arrows 14. This evenly distributed negative air pressure provides substantially the same suction effect at each of the holes 7 in the perforated sheet rubber material 6.

Reference is now made also to FIG. 2. The holes 7 in the sheet rubber material are arranged in a pattern which substantially corresponds to the shape of the projection on the seat and the backrest of those parts of the body that would normally bear thereupon. Thus the holes in the seat, seen from above, are arranged in the form of a letter U, corresponding to the extension of the thighs and buttocks of a person sitting in the chair. The sheet rubber material arranged for the backrest is perforated along a line substantially corresponding to the spinal column of the person. The suction-equalizing device formed by the perforated sheet rubber material and its contents causes substantially equal amounts of air to be drawn through the, woollen layers 2 and 5 in the vicinity of each of the holes. Woollen layer 2 will spread the suction effect somewhat, so that it is applied to a larger area of the support surfaces of the seat than would correspond to a direct projection of the corresponding holes 7. The effect of this is that a coherent area corresponding to the support surfaces against which a person's thighs and buttocks bear will have air drawn through it. By this means, those parts of the body in contact with the seat will be cooled by the passage of the air and kept dry. A very good and appropriately large transport of heat from these contact surfaces of the body can thereby take place. The suction-equalizing arrangement not only produces air stream evenly distributed over the relevant surfaces, but also ensures by means of the disposal of the holes 7 that the suction effect is limited to these contact surfaces. Through the latter fact suction is avoided where it is completely superfluous, which makes possible a great economy of power, so that the suction turbine can run at a rate as low as possible and be made as silent as possible. Ideally, the noise made by the suction turbine should not be audible by a person sitting in the chair. This aim is more easily achieved if a suction turbine is mounted in the baggage space of the vehicle, but also other locations, such as in the engine compartment, are possible, if there is space. It should be noted, however, that the "noise" of the suction turbine is at such a low level that it could also be mounted in the same air space, close to the chair. Preferably, it should be possible to regulate the speed of rotation of the suction turbine, so that it can be adjusted according to the conditions, of temperature, clothing, etc.

FIG. 2 shows how the backrest 15 and seat 1 of a chair according to the invention each are composed by a suction-equalizing device, and each device has an opening, through a branching connected to the same tube 12 leading to a suction turbine 13. It would also be possible, though hardly to be recommended, to construct backrest and seat as one piece, using the same perforated, bag forming sheet rubber material in the construction of the backrest as well as the seat.

Figure 3:
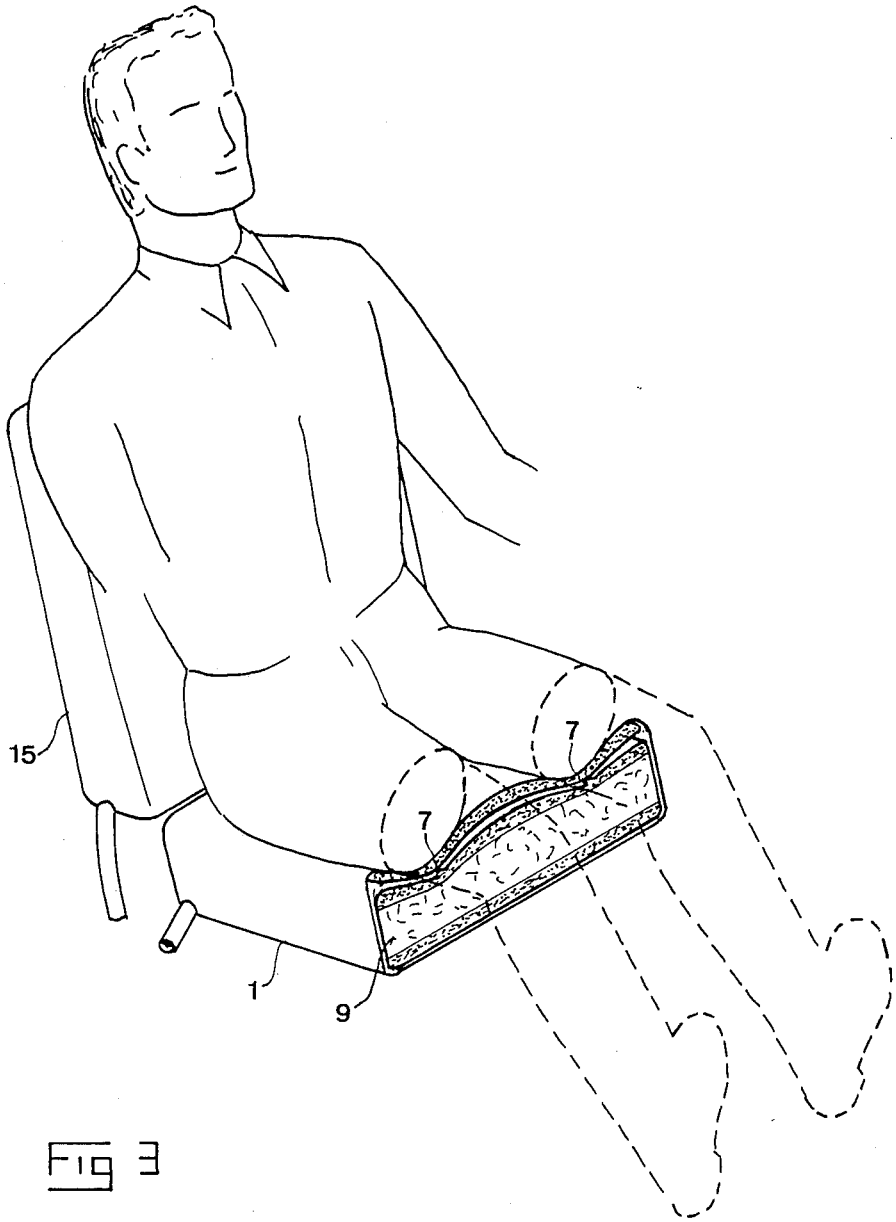
FIG. 3 is a perspective cross-sectional view of a driver's seat contructed according to the invention, compressed by the weight of a person seated on it.

FIG. 3 shows how the seat 1 will be compressed by the weight of the person sitting on it. It is clearly shown how the foamed plastic body 9 is thereby deformed and also has a shock-absorbing and comfort-enhancing function. The first horsehair layer 8 prevents those parts of the perforated sheet rubber material that are under compressive load from making direct contact with the upper side of the foamed plastic body, which would otherwise seal the surface pores and cause an uneven distribution of negative air pressure. The presence of the first fibrous layer 8 is therefore necessary, while it would be possible, though not recommended, to omit the second fibrous layer 10.

The elastic sheet rubber material bag is a very important feature of the present invention. It eliminates the need for air channels or tubes inside the chair. This is a great advantage, as air channels can easily be closed by the loads exerted thereon by a person sitting in the chair, and air tubes seriously decrease the sitting comfort, so that it will be uncomfortable to sit in the chair for any length of time. The device according to the invention is most useful at ambient temperatures between 18° and 38° C.

The invention is not in any way limited to the preferred embodiment described above, but a man skilled in the art should without difficulty be able to find out a number of possible modifications, without thereby departing from the basic idea of the invention.

It would be possible, for example, to replace the suction turbine by any other suitable suction device.

The electrical heating layer could be omitted if this was desirable, in which place only one woollen layer would be necessary.

Although it has been found very advantageous to use wool as the air-permeable material for the support surfaces in question, it would be feasible to use any other material with similar properties. The virtually airtight material enclosing the sides, underside and back of the chair could be omitted and replaced by an air-permeable layer, although it would then be advisable to retain a layer of such a virtually airtight material around the air-permeable portions at least in the region of said support surfaces in order to avoid suction of air from portions against which parts of the body of a person do not bear.

The foamed plastic and the horsehair of the porous body and the fibrous layer, respectively, could be replaced by any other material with similar properties.

The opening for the tube to the suction device could be closer to the woollen layer if this was desirable, but it would then be necessary to arrange some kind of airtight duct inside the bag emerging close to the underside of the foam plastic body and there creating a negative air pressure.

It would also be possible to locate the opening directly under the seat and the rearside of the backrest, respectively, or give it any other suitable location.

Although a U-shape and a line, respectively, are preferred for the patterns formed by the holes in the perforated member, other patterns would also be feasible, although they would not be nearly as effective.

We claim:

1. In a body-supporting device forming at least one of the seat and backrest of a chair and arranged to avoid sweating caused by the thermal insulating capacity of the chair, wherein at least those sections of the exterior surface of the device that form support surfaces for parts of the body of a person sitting in the chair are made of a material that is easily permeated by air, at least one opening to the exterior is provided in said device to communicate with the interior side of said air-permeable sections, a suction device is provided capable of creating a negative air pressure and is connectable to said at least one opening, and the interior of the body-supporting device is so arranged that the suction device, when connected and running, causes air that is exterior to said support surfaces to be drawn through the air-permeable sections via the interior of the body-supporting device and out of it through said at least one opening and a suction-equalizing means is provided to produce a substantially even distribution of negative air pressure generated by the suction device over the inner side of the air-permeable sections forming the support surfaces, the improvement wherein the suction-equalizing means comprises:

a bag of substantially airtight material on the interior side of said air permeable material opposite to said external surface;

at least one opening in said bag tightly connected to said at least one opening in the chair connectable to the suction device;

a plurality of holes through said bag located adjacent to said sections forming said support surfaces and arranged in a substantially U-shaped pattern in the seat and a substantially straight line pattern in the backrest;

a porous air stream diverging body of foamed plastic within said bag having side walls tightly engaging portions of said bag and closing outer pores in said side walls, a first large surface facing said holes and a second large surface facing in a direction substantially away from said first large surface, said at least one opening in said bag being adjacent a part of said second large surface so that air drawn into said bag by said suction device through said holes passes through said porous body and through said at least one opening;

a first layer of fibrous material disposed between said first large surface and said bag so that engagement of said bag against said first large surface and resultant sealing of surface pores of said porous body at said first large surface are prevented and air drawn through said holes into said bag passes through said first layer of fibrous material.

2. A device as claimed in claim 1, wherein:

at least said exterior surfaces of the body-supporting device adjacent to said support surfaces are made of substantially airtight material, so that substantially all air drawn through said holes passes through said support surfaces.

3. A device as claimed in claim 2 wherein said elastic bag is made of elastic sheet rubber material.

4. A device as claimed in claim 2 wherein said air-permeable material comprises wool.

5. A device as claimed in claim 1 wherein:

a second layer of fibrous material is disposed between said second large surface of said porous body and said bag; and said bag bears tightly against said side walls and said fibrous material layers to prevent air from bypassing said porous member so that air drawn from the exterior of the sections forming support surfaces to said at least one opening passes through said porous body.

6. A device as claimed in claim 5 forming both seat and backrest of a chair, wherein:

each seat and backrest comprises interior to said air-permeable sections said bag with said holes containing an assembly of said fibrous layers and foamed plastic body, and an opening in each bag for connection to said suction device, and said openings are located respectively at the lower part of the backrest and at the rear of the seat on the same side of the chair to enable simple connection of both elastic bags to said suction device.

7. A device as claimed in claim 6 wherein said elastic bag is made of elastic sheet rubber material.

8. A device as claimed in claim 6 wherein said air-permeable material comprises wool.

9. A device as claimed in claim 8 wherein said air-permeable material comprises wool.

10. A device as claimed in claim 5 wherein said elastic bag is made of elastic sheet rubber material.

11. A device as claimed in claim 10 wherein said air-permeable material comprises wool.

12. A device as claimed in claim 5 wherein said air-permeable material comprises wool.

13. A device as claimed in claim 1, wherein said air-permeable material comprises wool.

14. A device as claimed in claim 13 wherein said elastic bag is made of elastic sheet rubber material.

15. A device as claimed in claim 1 wherein said elastic bag is made of elastic sheet rubber material.

16. A device as claimed in claim 15 wherein said air-permeable material comprises wool.

17. A body supporting device forming both the seat and backrest of a chair arranged to avoid sweating caused by thermal insulating capacity of the chair, each of the seat and backrest comprising:

an exterior surface having sections forming support surfaces for parts of the body of a person sitting in the chair, at least said sections forming said support surfaces being made of air permeable material;

a bag of substantially airtight material on the interior side of said air permeable material opposite to said exterior surface;

a plurality of holes through said bag located adjacent to said sections forming said support surfaces and arranged in a pattern substantially corresponding respectively to a shape of a projection onto said seat and backrest of those parts of a persons body intended to bear thereon comprising a U-shaped pattern on the seat corresponding to the shape formed by the thighs and buttocks of a person, and a line on the backrest substantially corresponding to a projection of the spinal column of a person onto the backrest, so that air drawn through said holes into said bag is concentrated to but evenly distributed over said sections of said exterior surface forming said support surfaces;

a porous, air stream diverging body of foamed plastic within said bag and having a first large surface facing said holes and a second large surface facing in a direction opposite to said first large surface, said porous body being designed to create negative pressure uniformly distributed over said first large surface by air drawn through said porous body to produce an equal effect of said pressure to all of said holes;

a first layer of fibrous material comprised of horsehair disposed between said first large surface and said bag so that engagement of said bag against said first large surface and resultant sealing of surface pores of said porous body at said first large surface are prevented and air drawn through said holes into said bag passes through said first layer of fibrous material;

a second layer of fibrous material disposed between said second large surface and said bag;

an opening in said bag on the side of said porous body on which said second layer of fibrous material is located, the opening in the seat being at the rear thereof and the opening in the backrest being at the lower part thereof and on the same side of the chair as the opening in the seat; and a suction turbine device connectable to said openings for creating a negative air pressure at said opening, so that operation of said suction turbine device draws air evenly distributed by said porous body through said fibrous material and said holes for removing heat radiated by the body of the person and cooling the persons body in the region of said support surfaces, said bag bearing tightly against said fibrous material and said porous body for preventing air drawn by said suction turbine device from bypassing said porous body.

18. The device as claimed in claim 17 wherein:

at least said exterior surface adjacent to said supporting surfaces comprises airtight material so that substantially all air drawn through said holes passes through said support surfaces.

19. The device claimed in claim 17 wherein:

said air permeable material comprises wool.

* * * * *